US008857795B2

(12) United States Patent
Nishita et al.

(10) Patent No.: US 8,857,795 B2
(45) Date of Patent: Oct. 14, 2014

(54) TILTABLE SUPPORT POST STRUCTURE

(71) Applicant: Protec Engineering, Inc., Niigata (JP)

(72) Inventors: Yoichi Nishita, Niigata (JP); Toshimitsu Nomura, Niigata (JP); Shoichi Inoue, Niigata (JP)

(73) Assignee: Protec Engineering, Inc., Nigata (JP)

( * ) Notice: Subject to any disclaimer, the term of this patent is extended or adjusted under 35 U.S.C. 154(b) by 147 days.

(21) Appl. No.: 13/704,032

(22) PCT Filed: Oct. 3, 2012

(86) PCT No.: PCT/JP2012/075648

§ 371 (c)(1),
(2), (4) Date: Dec. 13, 2012

(87) PCT Pub. No.: WO2014/013631

PCT Pub. Date: Jan. 23, 2014

(65) Prior Publication Data

US 2014/0196382 A1 Jul. 17, 2014

(30) Foreign Application Priority Data

Jul. 17, 2012 (JP) ..... 2012-158268

(51) Int. Cl.

| | |
|---|---|
| ***E01F 7/04*** | (2006.01) |
| ***E04H 17/08*** | (2006.01) |
| ***E04H 12/22*** | (2006.01) |
| ***A63C 19/06*** | (2006.01) |

(52) U.S. Cl.

CPC ..... *E04H 12/2284* (2013.01); *E01F 7/045* (2013.01); *E04H 17/08* (2013.01); *A63C 19/062* (2013.01)

USPC ..... 256/12.5; 52/148; 404/10

(58) Field of Classification Search

CPC ..... E01F 7/00; E01F 7/02; E01F 7/025; E01F 7/04; E01F 7/045; E04H 17/08; A63C 19/062

USPC ..... 52/146, 148, 165; 404/9, 10; 256/1, 256/13.1, 14; 248/511, 530; 135/118, 120.1

See application file for complete search history.

(56) References Cited

U.S. PATENT DOCUMENTS

| | | | | |
|---|---|---|---|---|
| 1,599,928 | A * | 9/1926 | Sweeney | 40/608 |
| 4,032,248 | A * | 6/1977 | Parduhn et al. | 404/10 |

(Continued)

FOREIGN PATENT DOCUMENTS

| | | |
|---|---|---|
| JP | A-05-295713 | 11/1993 |
| JP | A-2001-107321 | 4/2001 |

(Continued)

OTHER PUBLICATIONS

Jan. 8, 2013 International Search Report issued in Application No. PCT/JP2012/075648.

(Continued)

*Primary Examiner* — Michael Safavi
(74) *Attorney, Agent, or Firm* — Oliff PLC

(57) ABSTRACT

A support post structure includes: a ground plate mounted on a support post anchor driven into the ground or a concrete base; a support post; a universal joint for tiltably supporting a lower end of the post; a lower support plate placed on an upper end of the post; a spring; an upper support plate; a bolt inserted through the lower support plate, the spring, and the upper support plate; a nut threaded into the bolt; and a rope hanging between a mooring part of the bolt and a predetermined position near the lower end of the post. The support post is brought to a standing state when the rope is tightened by the nut and is tiltable in all directions when a guard fence receives a falling rock or the like, autonomously restoring to the initial standing state when the rock is removed.

8 Claims, 7 Drawing Sheets

(56) References Cited

U.S. PATENT DOCUMENTS

| | | | | | |
|---|---|---|---|---|---|
| 4,047,701 | A | * | 9/1977 | Glaesener | 256/13.1 |
| 4,238,096 | A | * | 12/1980 | Dvorachek | 248/75 |
| 5,215,283 | A | * | 6/1993 | Gould | 248/145 |

FOREIGN PATENT DOCUMENTS

| | | |
|---|---|---|
| JP | B2-3289238 | 6/2002 |
| JP | B2-3619962 | 2/2005 |
| JP | A-2006-183327 | 7/2006 |
| JP | A-2011-032829 | 2/2011 |
| JP | A-2011-47217 | 3/2011 |
| JP | A-2011-89374 | 5/2011 |

OTHER PUBLICATIONS

Jan. 8, 2013 Written Opinion of the International Searching Authority issued in Application No. PCT/JP2012/075648.

* cited by examiner

TILTABLE SUPPORT POST STRUCTURE

TECHNICAL FIELD

The present invention relates to a support post structure that allows a support post to tilt in all directions when the support post receives a falling object due to rock fall, avalanche, mudslide, and the like.

BACKGROUND ART

As the support post structure for guard fence, there is known a support post structure configured such that a ground plate is fixedly mounted to a lower part of a support post, and a plurality of anchors fix the ground plate. In the above described support post structure for guard fence, a linkage part of the support post and the ground plate may be easily broken due to stress concentration, and the anchor may be easily broken or withdrawn. Furthermore, since a plurality of anchors are required to fix the ground plate, it is time consuming to fix the support post. Furthermore, since the support post structure is not detachable and reinstallable, the guard fence has to stand all through the winter. As a result of this, the guard fence may be easily deformed and broken due to snow pressure.

There is another support post structure in which a lower end of a support post of a guard fence is connected to a ground plate via a hinge part, which allows tilting only in a limited direction. However, when the above described support post structure receives an impact toward a non-tiltable direction, the support post structure may be easily broken at the hinge part of the lower end of the support post. Furthermore, an anchor may be easily broken or withdrawn when an external force is applied in a direction other than a rotatable direction of the hinge part at the time of receiving the impact.

In order to deal with these problems, Patent Documents 1 to 3, which will be described below, disclose support post structures for guard fence that allow the guard fence to tilt in all directions when the guard fence receives a falling object caused by rockfall, avalanche, mudslide, or the like, and guard fences provided with the support post for the guard fences.

Japanese Unexamined patent application, Publication No. 2011-32829 (Patent Document 1) discloses a guard fence provided with a tiltable support post that can tilt in all directions. The tiltable support post is configured as follows. A support post anchor has been driven into the ground, a ground plate is grounded in such a manner that a top part of the support post anchor is passing through anchor hole of the ground plate. Two constituent elements of a universal joint are respectively fixed to the ground plate and a connecting sleeve wherein the ground plate and the connecting sleeve are coupled via the universal joint in which the two elements are joined. The support post anchor is threaded into a hole of the universal joint, and connected using a screw nut. The support post is fixedly inserted into the connecting sleeve, and the connecting sleeve abuts with a bolt that is provided to a restriction plate, thereby restricting the support post from tilting toward a mountain side. Using the tiltable support post, when the support post receives a falling rock or the like, the support post tilts toward a direction in which an external force caused the falling rock or the like is exerted, thereby relaxing a bending stress at the universal hinge joint, and avoiding the anchor from being broken or withdrawn.

Japanese Patent No. 3289238 (Patent Document 2) discloses a falling rock preventive method of pocket type. According to this method, tiltable support posts are provided that can tilt in all directions to support a wire mesh covering an entire grid formed by horizontal and vertical ropes. Japanese Patent No. 3619962 (Patent Document 3) discloses a falling rock guard support post that is a tiltable support post similar to that of Patent Document 2. The tiltable support post according to Patent Document 3 is configured such that a support post anchor has been driven into the ground, a rope linked to the support post anchor is inserted through a support post of a cylindrical shape to which a mounting plate including an anchor hole is fixed. The support post is erected onto the support post anchor, and a holding fitting (buffer member) is provided to an end of the rope exposed from an upper end of the support post, thereby fixing the support post to a slope. According to the tiltable support post according to Patent Document 3, when the support post receives a falling rock or the like and tilted, if a tension on the rope does not exceed a limit, the rope expands and relaxes impact energy and then contracts and restores the support post to the initial standing state. However, in this case, since the expansion and contraction of the rope is not large in amount, the restoring force to the initial standing state is small. If a pressure of the falling rock is large and the tension on the rope exceeds the limit, the holding fitting (buffer member) slides the rope from its retaining position to absorb the impact energy.

SUMMARY OF THE INVENTION

However, according to the tiltable support post used in guard fence described in Japanese Unexamined patent application, Publication No, 2011-32829 (Patent Document 1), the support post, which once tilted upon receiving the falling rock or the like, maintains the tilted state even after the falling rock is removed. Therefore, the guard fence is not autonomously restorable.

Furthermore, according to the tiltable support post disclosed in Japanese Patent No. 3289238 (Patent Document 2) and Japanese Patent No. 3619962 (Patent Document 3), in a case in which a pressure of the falling rock is large and the tension on the rope exceeds the limit, the support post becomes not autonomously restorable to the initial standing state. Furthermore, in this case, if the holding fitting (buffer member) does not smoothly function to slide the rope from the retaining position, there is a fear of rope breakage or anchor withdrawal.

The present invention has been made in view of the above described problems, and it is an object of the present invention to provide a support post structure such that a support post can be erected to be tiltable in all directions, and, if a guard fence receives a falling rock or the like and the support post is tilted, when the fallen rock or the like is removed, the support post can be autonomously restored to the initial standing state.

In order to solve the above described problems, in accordance with a first aspect of the present invention, there is provided a support post structure including: a support post anchor driven into the ground or a concrete base; a ground plate mounted on the support post anchor; a support post formed in a cylindrical shape; a universal joint for tiltably supporting a lower end of the support post; a lower support plate placed on an upper end of the support post and having a first bolt through hole; a spring placed on the lower support plate and having a hollow part; an upper support plate placed on the spring and having a second bolt through hole; a bolt having a first rope mooring part on a head part thereof, the bolt being inserted into the first bolt through hole of the lower support plate, the hollow part of the spring, and the second bolt through hole of the upper support plate; a nut threaded into a thread part of the bolt on the upper support plate; and a rope provided in a hanging manner between the first rope mooring part and a predetermined position in the vicinity of the lower end of the support post, wherein the support post is brought in a standing state when the rope is tightened up by the nut to a state of tension.

In the aforementioned support post structure, the universal joint may include a first element fixedly mounted to the ground plate and having a first rope through hole, and a second element fixedly mounted to the support post and having a second rope through hole, the first element 7 and the second element respectively having a concave spherical surface part and a convex spherical surface part to collectively form a spherical joint, the ground plate may have a third rope through hole, and the rope may be provided in a hanging manner via the first to third rope through holes between the first rope mooring part and a second rope mooring part, as the predetermined position in the vicinity of the lower end of the support post, provided on an upper end of the support post anchor driven into the ground coaxially with the support post.

In the aforementioned support post structure, the universal joint may include a first element of a cylindrical shape fixedly mounted to the ground plate, and a second element being an elastic member and disposed on an inner circumference of the first element, the first and second elements having hinge parts, and the rope may be provided in a hanging manner between the first rope mooring part and a second rope mooring part, as the predetermined position in the vicinity of the lower end of the support post, provided on the ground plate coaxially with the support post.

In the aforementioned support post structure, the elastic member may be a rubber plate.

In the aforementioned support post structure, the spring may be a coil spring or a leaf spring.

Advantageous Effects of Invention

According to the present invention, it becomes possible to provide a support post structure such that a support post can be erected to be tiltable in all directions, and, in a case in which a guard fence receives a falling rock or the like and the support post is tilted in a direction in which an external force caused by the falling rock or the like has been exerted, when the fallen rock or the like is removed, the support post can be autonomously restored to the initial standing state.

BRIEF DESCRIPTION OF DRAWINGS

FIG. 6 is a plane view of a guard fence constructed by four of the support post structures of FIG. 1 vertically installed one after another, in which

BEST MODE FOR CARRYING OUT THE INVENTION

In the following, a description will be given of embodiments of the present invention with reference to drawings.

First Embodiment

Figure 1:
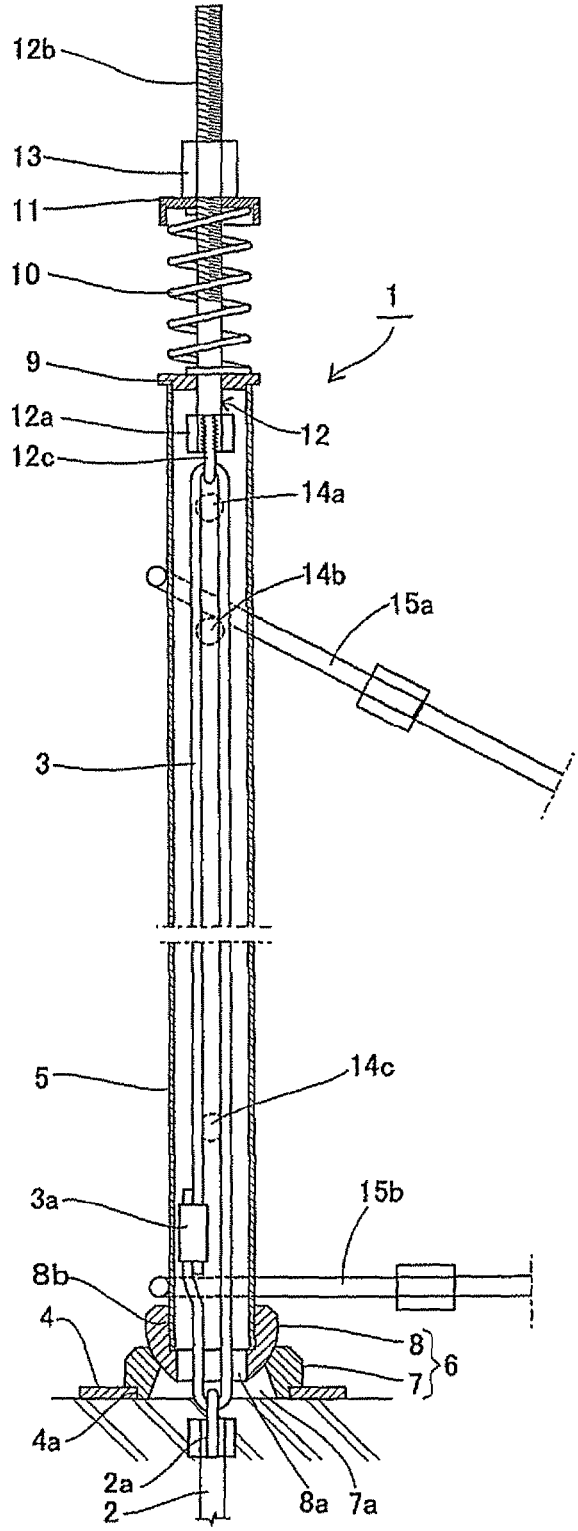
FIG. 1 is a vertical sectional front view of a support post structure in a standing state according to a first embodiment of the present invention.

The following description is directed to a first embodiment of the present invention. FIG. 1 is a vertical sectional front view of a support post structure 1 for guard fence in a standing state. The support post structure 1 for guard fence is provided with a rope 3 linked to a second rope mooring part 2*a* of a support post anchor 2 that has been driven into the ground, a ground plate 4 grounded on the support post anchor 2 and formed with a third rope through hole 4*a*, a support post 5 formed of a cylindrical body, a universal joint 6 including a first element 7 and a second element 8, respectively formed with a concave spherical surface part 7*b* and a convex spherical surface part 8*c*, which form a spherical joint, the first element 7 being fixedly mounted to the ground plate 4 and formed with a first rope through hole 7*a*, and the second element 8 being fixedly mounted to the support post 5 and formed with a second rope through hole 8*a* and a support post engagement recess part 8*b*, a lower support plate 9 that is placed on an upper end of the support post 5 and formed with a first bolt through hole 9*a*, a compression coil spring 10 that is placed on the lower support plate 9, an upper support plate 11 that is placed on the compression coil spring 10 and is formed with a second bolt through hole 11*a*, a long bolt 12 that is formed with a first rope mooring part 12*c* on a head part 12*a* thereof, a thread part 12*b* thereof being inserted from below the lower support plate 9 into the first bolt through hole 9*a* of the lower support plate 9, the compression coil spring 10, and the second bolt through hole 11*a* of the upper support plate 11, a screw nut 13 that is threaded from above the upper support plate 11 onto the thread part 12*b* of the long bolt 12, and mooring pins 14*a*, 14*b*, and 14*c* that protrude in a horizontal direction on an upper and a lower parts of the support post 5.

Hereinafter, a supplementary description is given of constituent elements.

As the rope 3, an anti corrosion processed wire rope is employed. In FIG. 1, the rope 3 is looped through and turned back at the first rope mooring part 12*c*, which is formed at the head part 12*a* of the long bolt 12, run through the support post 5 in a twofold manner, and looped through the support post anchor 2, which has been driven into the ground. And then, both ends of the rope 3 are detachably fastened using a binder 3*a* in the vicinity of the universal joint 6 to form a ring shape. However, the present invention is not limited to this mooring method.

As the ground plate 4, for example, a 10 mm thick steel plate in JIS standard of SS40C is employed. The ground plate 4 is in the form of a square shape, 200 to 300 mm on a side, having a first element fitting hole 4*a* at a center thereof, and plated by a zinc immersion process. The first element fitting hole 4*a* serves as the third rope through hole as well.

The support post 5 is a tube body having a cross section in a shape of polygon, circle, or the like, and a sufficient stiffness to support a guard net. More particularly, the support post 5 is formed of a zinc immersion treated steel pipe. The support post 5 is vertically installed using a mountain side retaining rope 15*a* looped between the mooring pins 14*a* and 14*b* and a mountain side retaining rope 15*b* looped below the mooring pin 14*c*.

The universal joint 6 is configured by the first element 7 and the second element 8 collectively forming a spherical joint, both elements being steel block bodies, for example. In FIG. 1, the first element 7 is formed with a concave spherical surface part, the second element 8 is formed with a convex spherical surface part, and the spherical joint is formed therebetween. Thus, the second element 8 on a movable side is configured to be spherically movable with respect to the first element 7 on a fixed side. The present embodiment includes a reversed configuration such that the first element 7 is formed with a convex spherical surface part, and the second element 8 is formed with a concave spherical surface part.

With regard to the connections between the first element 7 and the ground plate 4 and between the second element 8 and the support post 5, such connections cannot function to support the guard net if an impact of a falling rock or the like can easily break the connection between the first element 7 and the first element fitting hole 4*a* of the ground plate 4 or between the support post 5 and the support post engagement recess part 8*b* of the second element 8. Therefore, in order for the connections to function to support the guard net, the first element 7 is fixedly mounted to the ground plate 4, and the second element 8 is fixedly mounted to the support post 5. Here, "fixedly mounted" is intended to include fixation by threading and/or welding. However, the present invention is not limited thereto. As long as the pulling force exerted to the rope 3 caused by the compression coil spring 10 can maintain the tight engagements between the support post 5 and the second element 8 and between the first element 7 and the ground plate 4, and thus, function of guard net (wire net) 22 to support the guard net is sufficiently realized, any structure may be employed, such that, for example, the first element 7 simply fits in the first element fitting hole 4*a* of the ground plate 4, the support post 5 simply fits in the support post engagement recess part 8*b* of the second element 8, or the like. In FIG. 1, the above described configuration is employed, which enables a detachable assembly.

It may be sufficient that the lower support plate 9 is configured to be placed on the upper end of the support post 5 so as not to be displaced by the impact caused by a falling rock or the like. However, the present embodiment includes a configuration such that the lower support plate 9 is welded to the support post 5.

Figure 3:
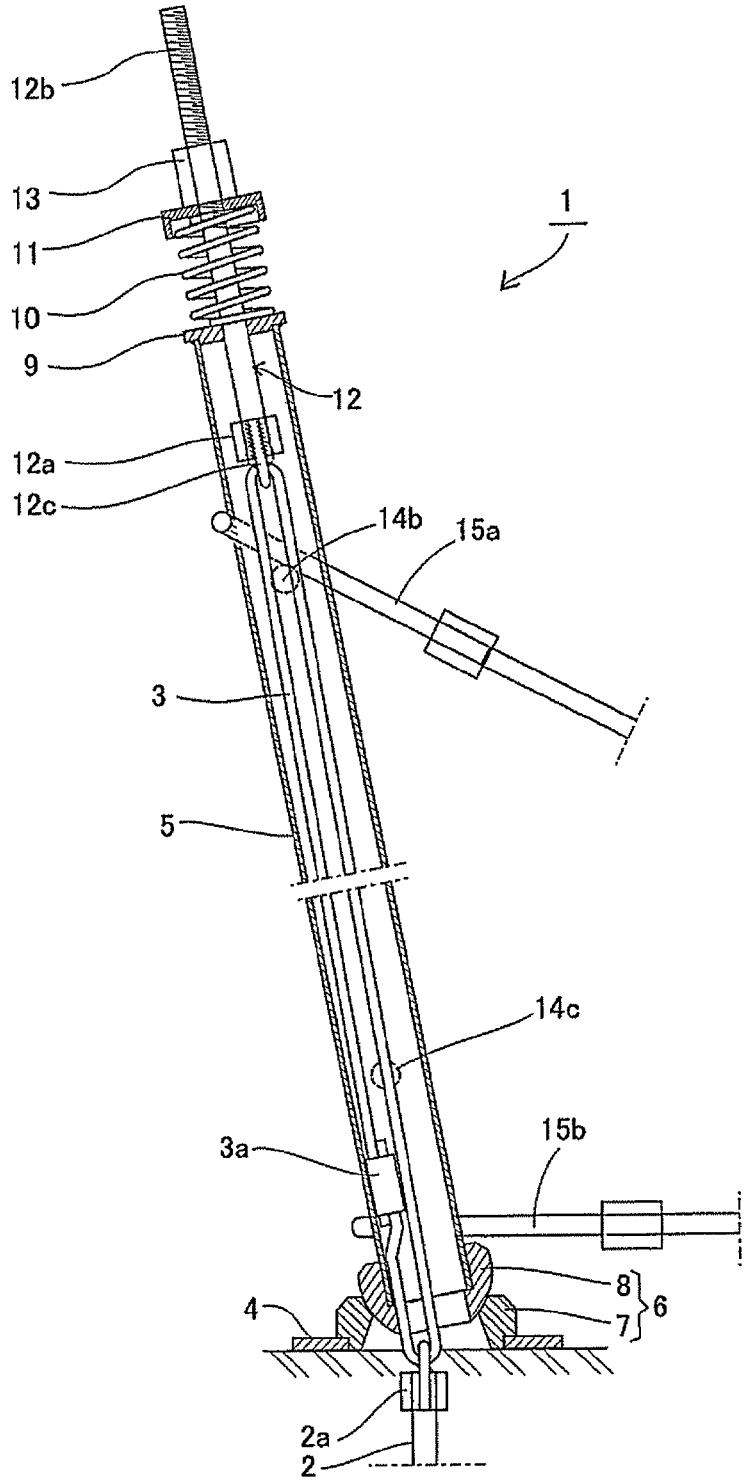
FIG. 3 is a vertical sectional front view of the support post structure of FIG. 1 in a tilted state.

FIG. 3 is a vertical sectional front view of the support post structure 1 for guard fence in a tilted state according to the first embodiment of the present invention. In the support post structure 1 for guard fence, a plurality of support posts 5 are vertically installed, and a guard net, which will be described later, is provided in a tensioned state, thereby forming a guard fence. When the guard net receives a falling rock or the like, the support post tilts as shown in FIG. 3 centering on a center of the universal joint 6. At this point of time, a tension is applied to the rope 3 that is hung between the second rope mooring part 2*a* of the support post anchor 2 and the first rope mooring part 12*c* of the long bolt 12, and the compression coil spring 10 is compressed to allow the tilt of the support post 5. When the tilting force to the support post 5 diminishes or disappears, a restoring force of the compressed coil spring 10 causes the tension on the rope 3, thereby restoring the support post 5 to the standing state.

Figure 2:
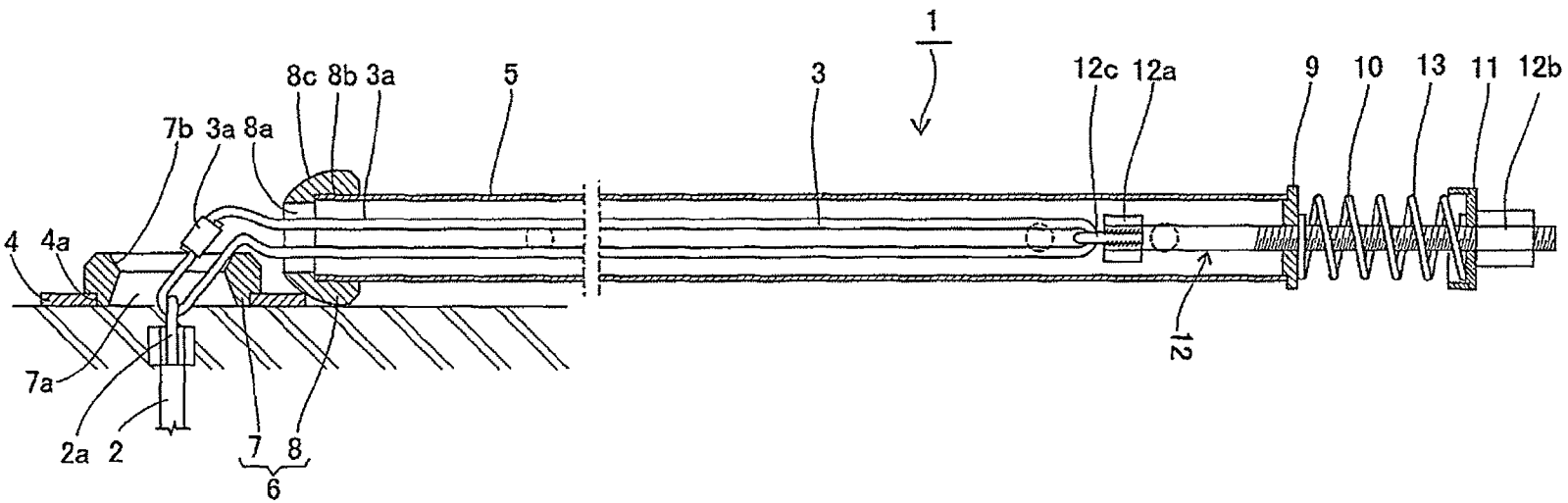
FIG. 2 is a vertical sectional front view of the support post structure illustrating an assembly procedure of the support post structure of FIG. 1.

The following description is directed to an example of an erecting procedure of the support post 5 according to the support post structure 1 for guard fence configured as described above with reference to FIG. 2.

First, the lower support plate 9, the compression coil spring 10, and the upper support plate 11 are placed one on top of another, through which the long bolt 12 is inserted from below the lower support plate 9, and the screw nut 13 is threaded onto the thread part 12*b* of the long bolt 12. Then, the rope 3 is looped through the first rope mooring part 12*c* provided to the head part 12*a* of the long bolt 12, both ends of the rope 3 are inserted through the support post 5, and the head part 12*a* of the long bolt 12 is inserted into the support post 5.

The ground plate 4, which has the first element 7 fittingly placed on a top surface thereof, is grounded on the support post anchor 2 that has been driven into the ground. The both ends of the above described rope 3 that passes through the support post 5 are made run through the second element 8. Then, one end of the rope 3 is made run through the second rope mooring part 2*a* of the support post anchor 2, and the both ends of the rope 3 are fastened.

Subsequently, the first element 7 is engaged with the second element 8. The support post 5 is fit in the second element 8 and erected. While maintaining the support post 5 in the standing state, the screw nut 13 is tightened until the compression coil spring 10 is slightly compressed. A plurality of retaining ropes, which will be described later, are moored to the upper and lower parts of the support post 5, and stretched in a mountain side direction and lateral directions (right and left hand directions viewing the mountain from the valley), thereby fixing the support post 5 in the standing state.

In the support post 5 thus erected, the second element 8 is received by the first element 7 in a spherically movable manner. Therefore, the support post 5 stands, allowing twist and tilt in all directions centering on the universal joint 6.

Figure 6A:
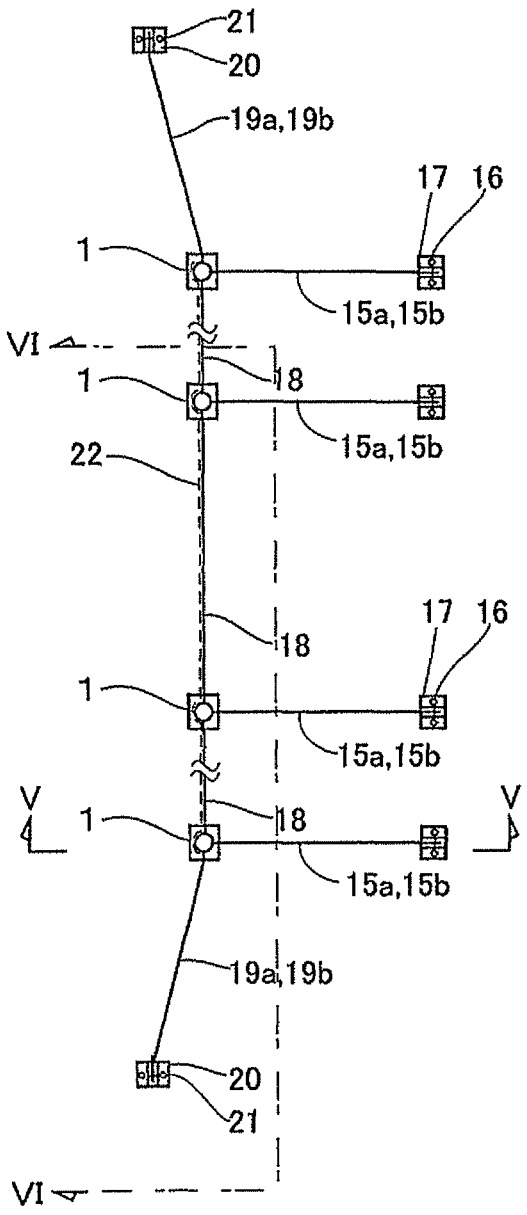
FIG. 6A is a plane view of the first embodiment.
Figure 7:
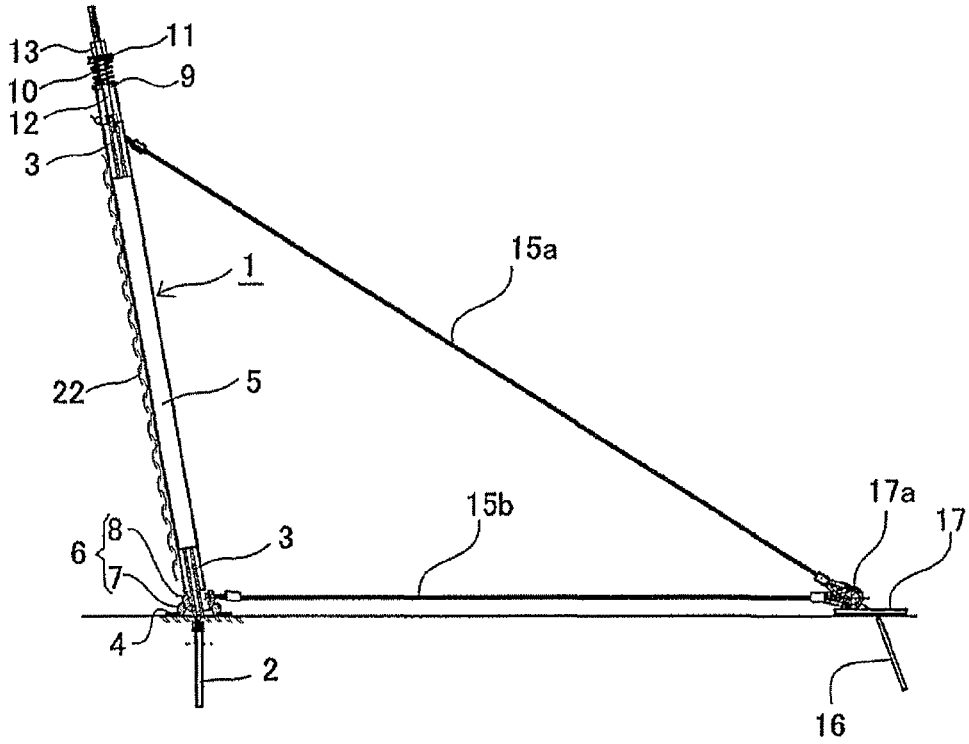
FIG. 7 is a cross sectional view of the guard fence shown in FIG. 6A along the line V-V.
Figure 8:
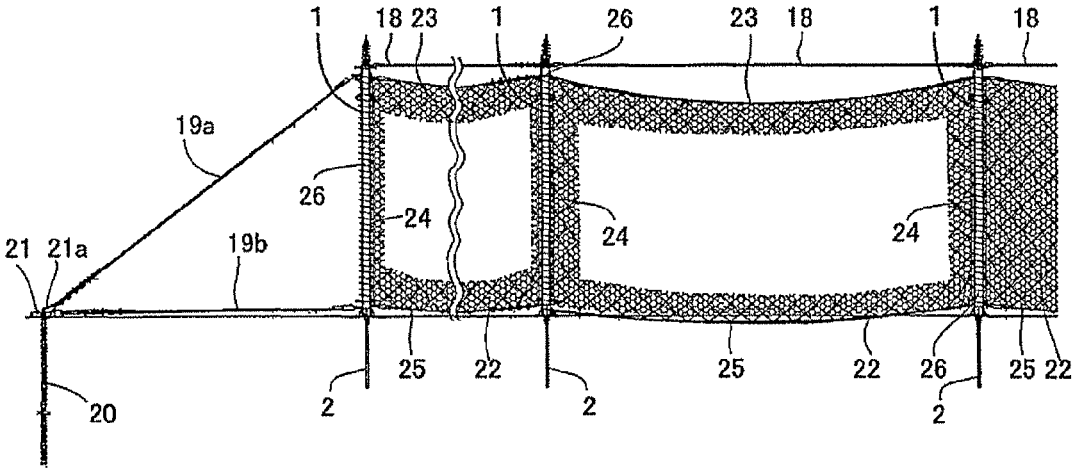
FIG. 8 is a cross sectional view of the guard fence shown in FIG. 6A along the line VI-VI.

The above described procedure is directed to a case of vertically installing a single support post 5. In order to construct a guard fence, for example, as shown in FIGS. 6A, 7, and 8, four of the support posts 5 are vertically installed at required intervals, and a guard net (wire net) 22 is stretched in a tensioned manner between the support posts 5.

In order to vertically install four support posts, in addition to the above described procedure to vertically install a single support post 5, the following procedures are required. This means that the upper and lower parts of each support post 5 are respectively linked via two mountain side retaining ropes 15*a* and 15*b* to a rope mooring part 17*a* of the mountain side base plate 17 that is fixed by a mountain side anchor 16. Also, the upper parts of a pair of adjacent support posts 5 are linked via a shape retention rope 18, and the upper and lower parts of each support post 5 on right and left ends are respectively linked via end part retaining ropes 19*a* and 19*b* to a rope mooring part 21*a* of an end part base plate 21 that is fixed by an end part anchor 20.

The mountain side anchor 16 has been driven into the ground on a mountain side slope corresponding to each support post 5, and the end part anchor 20 has been driven into the ground at a location in a lateral direction of the support post 5 on each end, deviated to a valley side with respect to a line extending in an arrangement direction of the support posts 5.

After the four support posts 5 are vertically installed in accordance with the above described procedure, the guard net (wire net) 22 is stretched in a tensioned manner between each pair of adjacent support posts 5. Here, an upper side of the guard net 22 is supported by an upper transverse rope 23 that is linked to upper parts of each pair of adjacent support posts 5, and a lower side of the guard net 22 is supported by a lower transverse rope 25 that is linked to lower parts of each pair of adjacent support posts 5 as well. Then, a longitudinal rope 24 of a lateral side of the guard net 22 is fastened to the support post 5 by winding a lateral fastening rope 26 around the support post 5, and a pair of adjacent lateral sides of respective guard nets 22 are fastened to the support post 5 by winding a lateral fastening rope 26 around the support post 5, thereby connecting the pair of adjacent lateral sides.

When the guard net 22 receives a falling rock or the like, a tilting force is exerted on the support post 5 via the upper transverse rope 23 and the lower transverse rope 25, the mountain side retaining ropes 15*a* and 15*b* bear the tilting force exerted on the support post 5, thereby avoiding the support post 5 from toppling. Since the support post 5 is vertically installed in a state allowing twist and tilt in all directions centering on the universal joint 6, the tilting force causes no bending moment, and no bending moment is applied to the support post anchor 2. As a result thereof, the support post structure 1 for guard fence has no fear of breakage at the lower end of the support post 5. The support post 5 tilts in accordance with the stretch of the mountain side retaining ropes 15*a* and 15*b*. Meanwhile, the compression coil spring 10 is compressed resisting the tilting force and absorbs energy thereof. Here, the support post anchor 2 is simply linked to the rope 3, and since the rope 3 transmits no shear force, there is no fear of breakage or withdrawal of the support post anchor 2. In the support post structure 1 for guard fence, when the support post 5 tilts by the guard net 22 receiving a kinetic energy of a falling rock or the like, the compression coil spring 10 is compressed and accumulates a restoring force. When the mountain side retaining ropes 15*a* and 15*b*, which have stretched by receiving the impact, return to an initial length, the accumulated restoring force of the compressed coil spring 10 restores the support post 5 toward an initial standing state. Furthermore, when the fallen rock or the like is removed from the guard net 22, the support post 5 is greatly restored to the initial standing state.

A removal procedure of the support post 5 includes the steps of loosening the screw nut 13, toppling the support post 5, exposing the both ends of the rope 3 at the lower part of the support post 5, and unfastening the both ends of the rope 3.

Second Embodiment

The following description is directed to a second embodiment of the present invention. The same constituent elements as the above described first embodiment are designated by the same reference numerals, and a description will be given of points different from the first embodiment.

Figure 4:
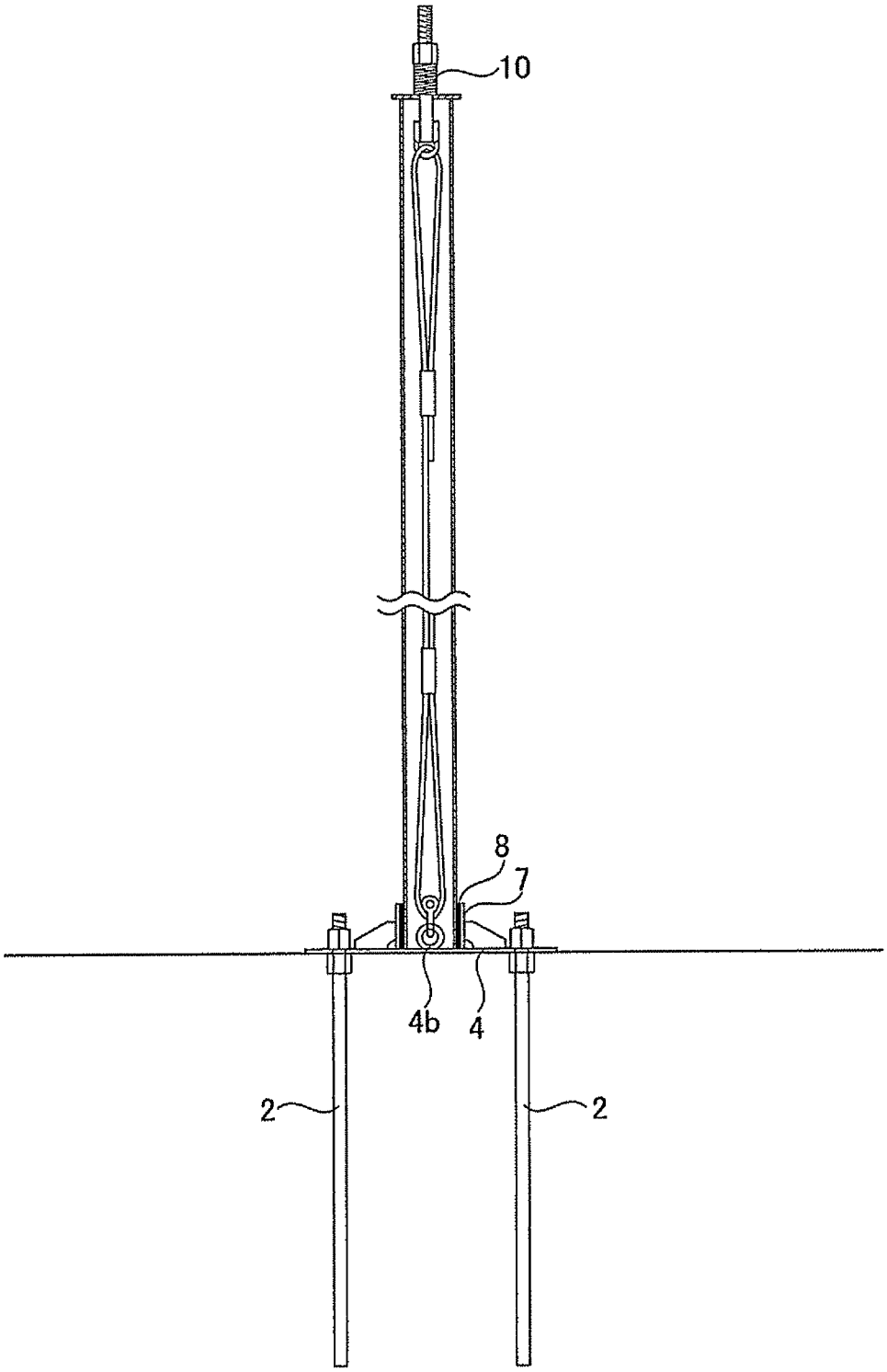
FIG. 4 is a vertical sectional front view of a support post structure in a standing state according to a second embodiment of the present invention.
Figure 5:
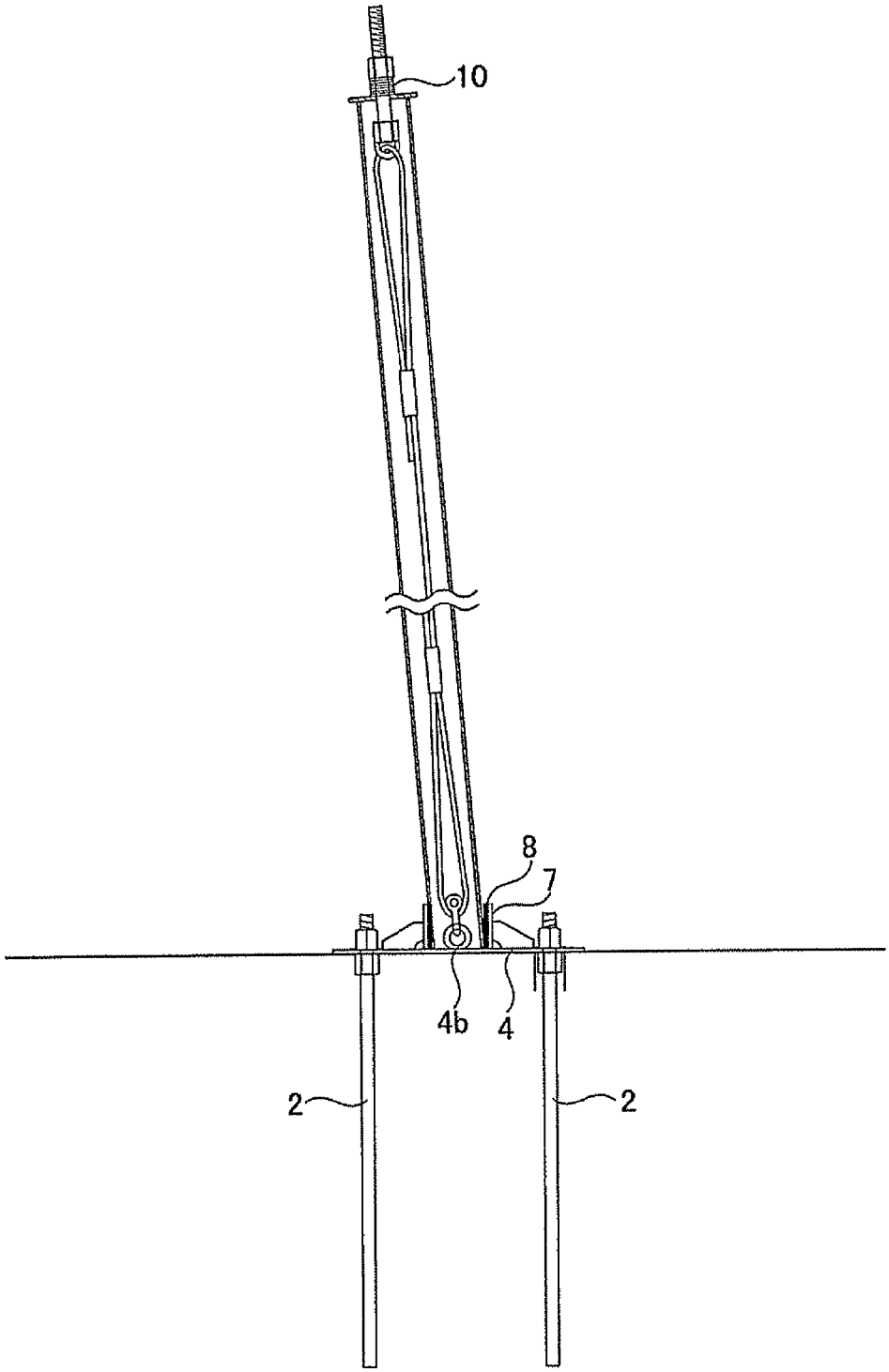
FIG. 5 is a vertical sectional front view of the support post structure of FIG. 4 in a tilted state.
Figure 6B:
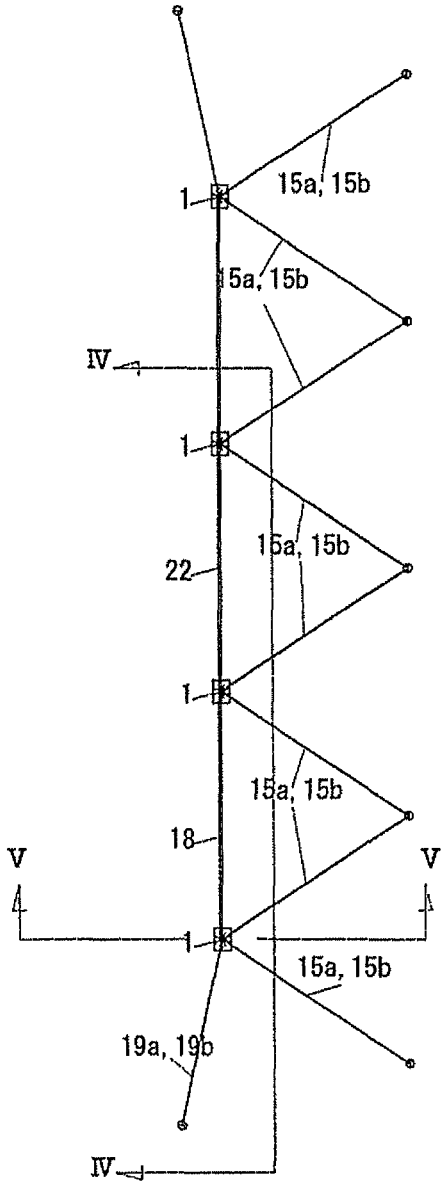
FIG. 6B is a plane view of the second embodiment.

FIG. 4 is a vertical sectional front view of a support post structure for guard fence in a standing state according to a second embodiment of the present invention. FIG. 5 is a vertical sectional front view of the support post structure for guard fence of FIG. 4 in a tilted state. FIG. 6B is a plane view of a guard fence constructed by vertically installing four of the support post structures according to the second embodiment. In the second embodiment, in place of the universal joint 6 having two elements collectively forming the spherical joint in the first embodiment, a hinge part is configured as a combination of a first element 7 of a cylindrical shape fixed to the ground plate 4 and a second element 8 formed of a cylindrical shaped rubber plate disposed inside of the first element 7. According to the above described configuration, the support post 5 can be made tiltably movable and autonomously restore the standing state by removing the fallen rock, as well. As the compression spring 10, in place of the coil spring in the first embodiment, a leaf spring is employed. The leaf spring is formed with a hollow part at a central portion thereof so that the long bolt 12 can be inserted through the leaf spring. Furthermore, although a single support post anchor 2 coaxial with the support post 5 is employed in the first embodiment, a plurality of support post anchors 2 are provided on both sides of the ground plate 4 in the second embodiment.

REFERENCE SIGNS LIST

1 Support Post Structure
2 Support Post Anchor
2*a* Second Rope Mooring Part (first embodiment)
3 Rope
4 Ground Plate
4*a* First Element Fitting Hole (Third Rope Through Hole)
4*b* Second Rope Mooring Part (second embodiment)
5 Support Post
6 Universal Joint
7 First Element
7*a* First Rope Through Hole
7*b* Concave Spherical Surface Part
8 Second Element
8*a* Second Rope Through Hole
8*b* Support Post Engagement Recess Part
8*c* Convex Spherical Surface Part
9 Lower Support Plate
9*a* First Bolt Through Hole
10 Compression Coil Spring
11 Upper Support Plate
11*a* Second Bolt Through Hole
12 Long Bolt
12*a* Head Part
12*b* Thread Part
12*c* First Rope Mooring Part
13 Screw Nut

What is claimed is:

1. A support post structure comprising:

a support post anchor driven into the ground or a concrete base;

a ground plate mounted on the support post anchor;

a support post formed in a cylindrical shape;

a universal joint for tiltably supporting a lower end of the support post;

a lower support plate placed on an upper end of the support post and having a first bolt through hole;

a spring placed on the lower support plate and having a hollow part;

an upper support plate placed on the spring and having a second bolt through hole;

a bolt having a first rope mooring part on a head part thereof, the bolt being inserted into the first bolt through hole of the lower support plate, the hollow part of the spring, and the second bolt through hole of the upper support plate;

a nut threaded into a thread part of the bolt on the upper support plate; and a rope provided in a hanging manner between the first rope mooring part and a predetermined position in the vicinity of the lower end of the support post, wherein the support post is brought in a standing state when the rope is tightened up by the nut to a state of tension.

2. The support post structure according to claim 1, wherein the universal joint includes a first element fixedly mounted to the ground plate and having a first rope through hole, and a second element fixedly mounted to the support post and having a second rope through hole, the first element and the second element respectively having a concave spherical surface part and a convex spherical surface part to collectively form a spherical joint, the ground plate have a third rope through hole, and the rope is provided in a hanging manner via the first to third rope through holes between the first rope mooring part and a second rope mooring part, as the predetermined position in the vicinity of the lower end of the support post, provided on an upper end of the support post anchor driven into the ground coaxially with the support post.

3. The support post structure according to claim 1, wherein the universal joint includes a first element of a cylindrical shape fixedly mounted to the ground plate, and a second element being an elastic member and disposed on an inner circumference of the first element, the first and second elements having hinge parts, and the rope is provided in a hanging manner between the first rope mooring part and a second rope mooring part, as the predetermined position in the vicinity of the lower end of the support post, provided on the ground plate coaxially with the support post.

4. The support post structure according to claim 3, wherein the elastic member is a rubber plate.

5. The support post structure according to claim 1, wherein the spring is a coil spring or a leaf spring.

6. The support post structure according to claim 2, wherein the spring is a coil spring or a leaf spring.

7. The support post structure according to claim 3, wherein the spring is a coil spring or a leaf spring.

8. The support post structure according to claim 4, wherein the spring is a coil spring or a leaf spring.

* * * * *

UNITED STATES PATENT AND TRADEMARK OFFICE

CERTIFICATE OF CORRECTION

PATENT NO. : 8,857,795 B2
APPLICATION NO. : 13/704032
DATED : October 14, 2014
INVENTOR(S) : Yoichi Nishita et al.

It is certified that error appears in the above-identified patent and that said Letters Patent is hereby corrected as shown below:

On the Title Page

Please correct the Assignee's address as follows:

Item (73) Assignee: delete "Nigata (JP)" and insert -- Niigata (JP) --.

Signed and Sealed this
Twenty-third Day of December, 2014

Michelle K. Lee

Michelle K. Lee
*Deputy Director of the United States Patent and Trademark Office*